US005890591A

United States Patent [19]

Pienta

[11] Patent Number: 5,890,591

[45] Date of Patent: Apr. 6, 1999

[54] PACKAGE FOR A ROLL AND METHOD OF MAKING

[75] Inventor: David J. Pienta, Erie, Mich.

[73] Assignee: Automatic Handling, Inc., Erie, Mich.

[21] Appl. No.: 88,242

[22] Filed: Jun. 1, 1998

Related U.S. Application Data

[63] Continuation-in-part of Ser. No. 878,736, Jun. 19, 1997, Pat. No. 5,850,918.

[51] Int. Cl.[6] ..... B65B 11/58; B65D 65/00

[52] U.S. Cl. ..... 206/410; 53/211; 53/399; 53/587

[58] Field of Search ..... 53/399, 211, 216, 53/587, 588; 206/389, 410, 413

[56] References Cited

U.S. PATENT DOCUMENTS

| | | |
|---|---|---|
| 2,067,111 | 1/1937 | Aberle . |
| 2,250,875 | 7/1941 | McConnell . |
| 3,895,711 | 7/1975 | Hiltunen et al. . |
| 3,924,375 | 12/1975 | Brenner et al. . |
| 4,235,062 | 11/1980 | Lancaster, III et al. . |
| 4,281,500 | 8/1981 | Mueller et al. . |
| 4,736,567 | 4/1988 | Pienta . |
| 4,746,011 | 5/1988 | McNair, Jr. et al. . |
| 4,882,892 | 11/1989 | Pienta . |
| 4,886,167 | 12/1989 | Dearwater . |
| 5,046,298 | 9/1991 | Norkoski et al. . |
| 5,131,209 | 7/1992 | Schreiber et al. . |
| 5,487,255 | 1/1996 | Soderberg . |

FOREIGN PATENT DOCUMENTS

| | | |
|---|---|---|
| 0 519 672 A | 12/1992 | European Pat. Off. . |
| 41 37 448 A1 | 5/1993 | Germany . |
| 92 17371 A1 | 10/1992 | WIPO . |

OTHER PUBLICATIONS

Drautzburg R: "Neue Verpackungstechnologie in DER Coilverpackung" Stahl UND EISEN, vol. 112, No. 7, 15 Jul. 1992, pp. 47–48, XP000293325.

Film Roll Wrapping with AutoWrappers Brochure, published by Automatic Handling.

Mark McCready, Automatic Handling's Innovative Philosophy Keeps it Rolling Along, PaperAge, Nov. 1989, pp. 28–30.

Zero–in on Zero Damage! pamphlet, published by Automatic Handling, Jan. 1996.

Stop Roll Damage! pamphlet, published by Automatic Handling, Apr. 1996.

Ten Steps to Zero Roll Damage advertisement, Converting Today, Jun. 1996.

Film Roll Wrapping Solutions for the Pulp and Paper Industry Brochure, Mechadyne Engineering & Machine, Sep. 1994.

Trancel Combination Roll Wrapping System Brochure, published by Trancel, Inc.

Heavy Duty Wrap and Roll pamphlet, published by Teno.

*Primary Examiner*—Jim Foster

*Attorney, Agent, or Firm*—Emch, Schaffer, Schaub & Porcello, Co., L.P.A.

[57] ABSTRACT

The invention is a package and the method of making the package. A roll to be enclosed has a longitudinal axis. A first layer of material is axially wrapped on the roll with the first layer extending generally parallel to the longitudinal axis. A second and a third layer are than radially wrapped over the first layer in a direction generally perpendicular to the longitudinal axis. The second layer is a protective cushion layer.

28 Claims, 6 Drawing Sheets

PACKAGE FOR A ROLL AND METHOD OF MAKING

RELATED APPLICATIONS

The present application is a continuation-in-part application of U.S. patent application Ser. No. 08/878,736 filed Jun. 19, 1997, U.S. Pat. No. 5,850,918.

BACKGROUND OF THE INVENTION

Packages for rolls and wrapping machines for making packages for rolls are well known in the art. A wrapping machine which includes means for wrapping radial layers of materials in an interleaved manner are shown in my prior U.S. Pat. No. 4,736,567 which was granted Apr. 12, 1988.

Another prior art wrapping machine is disclosed in my U.S. Pat. No. 4,882,892 issued Nov. 28, 1989. This prior art wrapping machine is a dual station wrapping machine where successive layers of material are positioned on a roll or body to be wrapped.

Prior art packages for rolls are disclosed in U.S. Pat. Nos. 2,250,875 and 5,487,255. An end disc is disclosed in U.S. Pat. No. 3,895,711.

Bodies or rolls to be wrapped by the improved package include paper rolls, such as carbonless paper rolls which are very sensitive to marking. Another type of body to be wrapped is a material roll, for example, a roll of plastic film material which is to be utilized to cover foods in the food industry. The package for this type of a roll must form a package which does not contaminant the film layers being wrapped.

SUMMARY OF THE INVENTION

The present invention is directed to an improved package for rolls and the method of making the improved package. The improved package is particularly adaptable for use in situations where the roll, which is being wrapped, must be protected from contamination or edge damage. While the roll being wrapped may have a shape other than a cylindrical shape, the present package and method of making, normally applies multiple layers to a generally cylindrical roll which has a longitudinal central axis and a pair of spaced ends. The roll to be wrapped also includes an outer surface which extends between the ends and is radially spaced from the longitudinal axis.

The roll includes an inner first layer, for example, a plastic film layer, which extends over the outer surface of the roll and is wrapped on the outer surface in a direction generally parallel to the longitudinal axis of the roll. The first layer also extends over the spaced ends.

A second layer is positioned over the first layer. The second layer is wrapped over the outer surface of the first layer adjacent to the spaced ends of the roll in a direction generally perpendicular to the longitudinal axis by using a radial wrap. The second layer is a protective layer, normally a cushion layer, such as a foamed plastic layer, a plastic bubble wrap layer, an extruded plastic layer or a corrugated or cardboard layer.

A third layer is positioned over the outer surface of the roll by using a radial wrap which is perpendicular to the axis of the roll.

In some embodiments, the second and third layers are interleaved with one another. In another embodiments, the second and third layers are successively wrapped.

In some embodiments, end protection, such as protective end disc is applied adjacent each end of the body.

DESCRIPTION OF THE PREFERRED EMBODIMENTS

Figure 3:
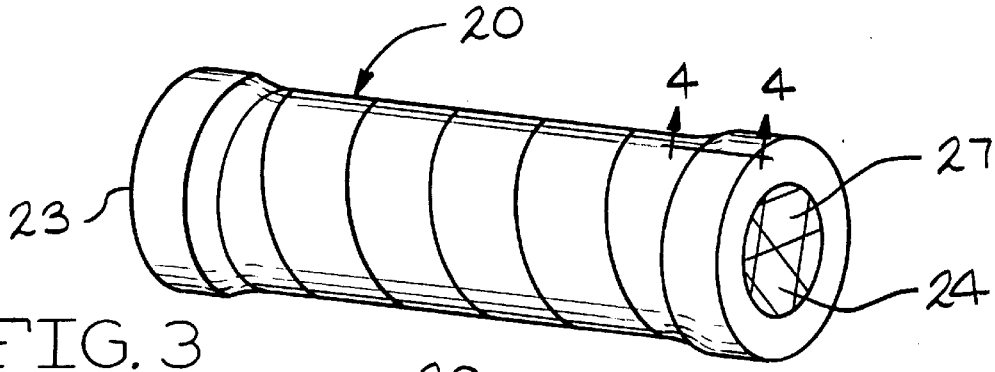
FIG. 3 is a perspective view, similar to FIG. 1, showing the package, according to the present invention after the second and third layers of wrapping material have been applied.

Referring to FIG. 3, a package, according to the present invention is generally indicated by the reference number 20. While the package 20 may be used to wrap articles of different shapes and configurations, it is particularly useful in wrapping cylindrical articles or bodies. These cylindrical articles are, for example, rolls of material, including rolls of surface sensitive papers and films or rolls of films which are to be used in wrapping food stuffs. In those types of items, improper packaging results in marking the sensitive layers in the first instance and possibly contaminating the food materials in the second instance.

Figure 1:
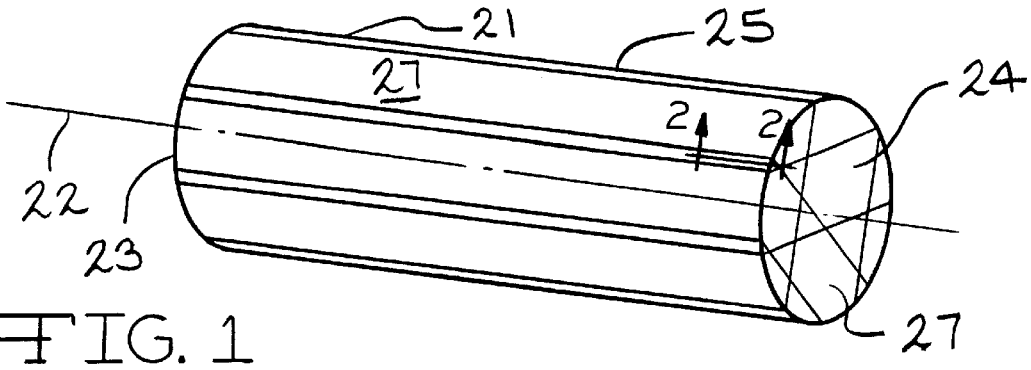
FIG. 1 is a perspective view of a package, according to the present invention, after the first layer of wrapping material has been applied to the roll being wrapped.
Figure 2:
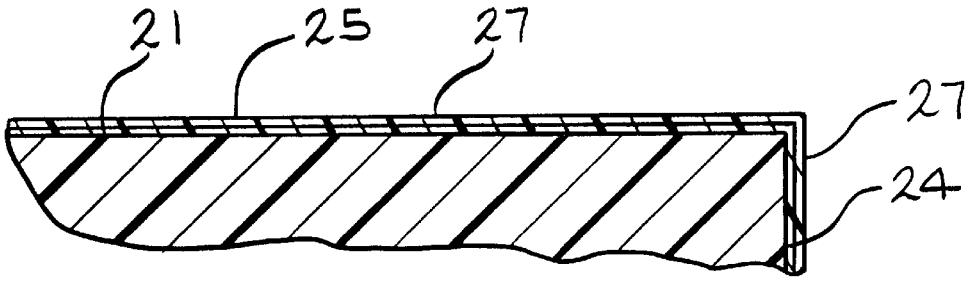
FIG. 2 is a fragmentary, enlarged cross-sectional view taken along the line 2—2 of FIG. 1.

Referring to FIG. 1, the package 20 is used to cover a longitudinally extending cylindrical roll 21. The cylindrical roll 21 has a longitudinal center axis 22, a pair of spaced ends 23 and 24 and a cylindrically shaped outer surface 25 extending between the ends 23 and 24.

The package 20 includes an inner first layer 27 which extends over the outer surface 25 in a direction generally parallel to the longitudinal axis 22. The first layer 27 also extends around the spaced ends 23 and 24, as shown in FIG. 1. The first layer 27 is preferably a plastic stretch film normally having a thickness between 60 gauge and 300 gauge. The plastic film is normally a polyethylene film. Other plastic films and layer materials may be used. The thicknesses and preferred materials for the three layers discussed with respect to the embodiments shown in FIGS. 1–13 also apply with respect to the embodiments shown in FIGS. 14–17.

Figure 9:
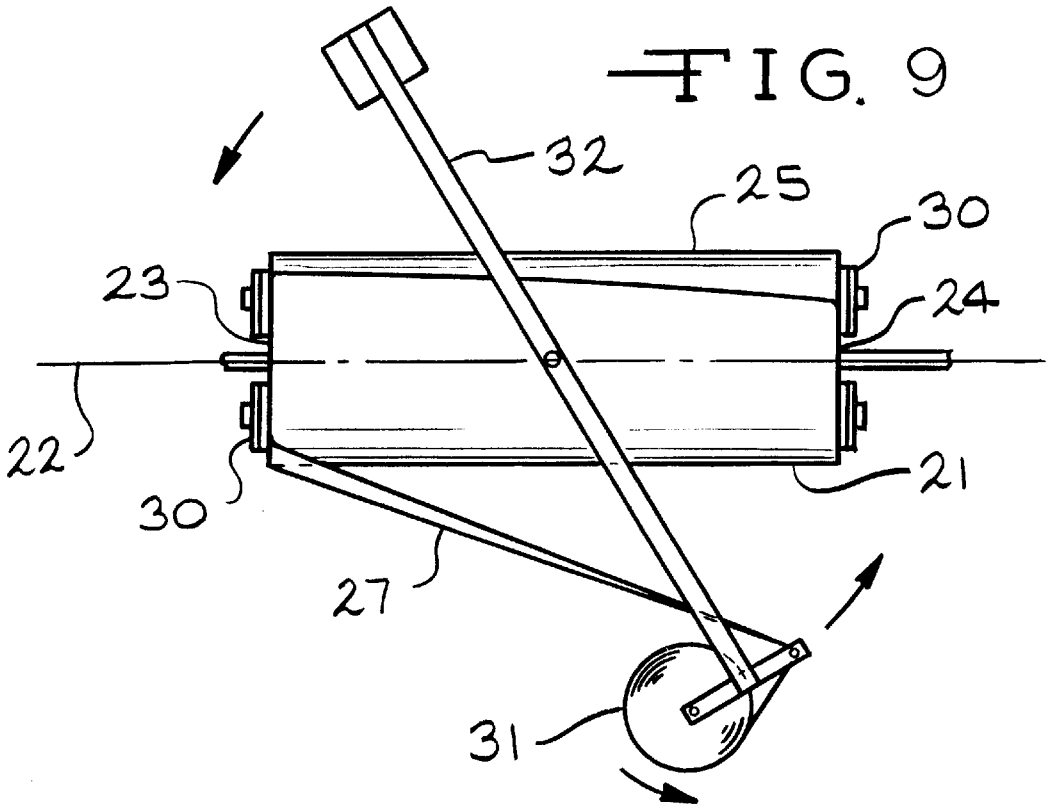
FIG. 9 is a diagrammatic view showing a method of making the package, according to the present invention, and showing in particular the application of the first layer to the roll being wrapped.
Figure 10:
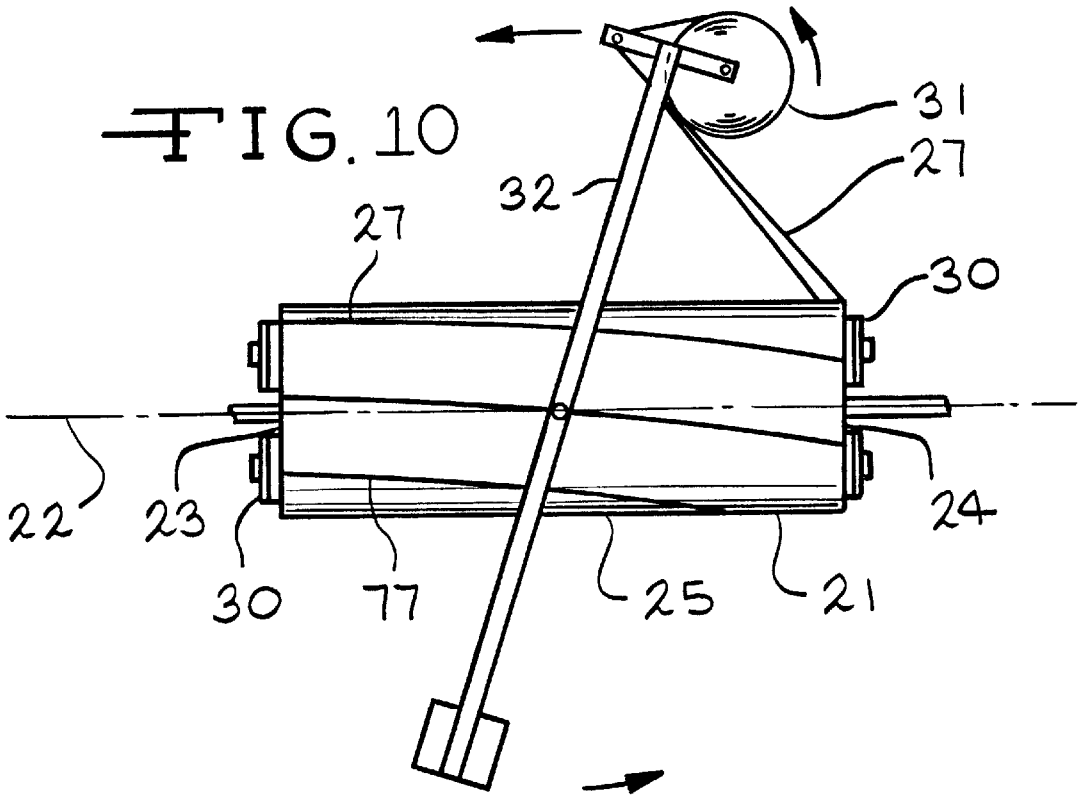
FIG. 10 is a view similar to FIG. 9, showing further wraps of the first layer being applied over the roll.

FIGS. 9–13 disclose a diagrammatic machine and method for making the package 20. Initially, the cylindrical roll 21, which is the article to be wrapped, is positioned on rollers 30. The first layer 27 is dispensed from a supply roll 31. In the present embodiment, the supply roll 31 is rotated to apply the first layer 27 to the cylindrical roll 21 such that the first layer 27 is positioned on the outer surface 25 in a direction generally parallel to the longitudinal axis 22. As shown in FIG. 9 and FIG. 10, multiple thicknesses of the film forming the first layer 27 are applied over the outer surface 25 and the ends 23 and 24 of the roll 21 as the supply roll 31 is rotated around the roll 21 by an arm 32.

The package 20 also includes a second layer 35 and a third layer 36. The second layer 35 and the third layer 36 are positioned over the first layer 27 on the roll 21. While the first layer 27 is applied axially in a direction generally parallel to the longitudinal axis 22 of the roll 21, the second layer 35 and the third layer 36 are applied radially over the outer surface 25 of the first layer 27 in a direction generally perpendicular to the longitudinal axis 22. The second layer 35 is preferably a protective cushion layer. The preferred materials for the second layer 35 include a foamed plastic cushioning material, a layer of plastic cushion bubble pack material, an extruded plastic material or a cardboard or corrugated paper material. The thickness of the second layer ranges between one mil and ⅜ inch. The foam material and the bubble pack material are typically ¼ inch thick. If a Kraft paper is used for a portion of the second layer it is normally thin and used only for product identification, where it is visible through an outer plastic film layer. If cardboard is used as the cushion layer it normally has a thickness between 1/32 inch and 1/16 inch. If a corrugated material is used as the cushion layer, it normally has a thickness between 1/16 inch and ¼ inch.

Figure 11:
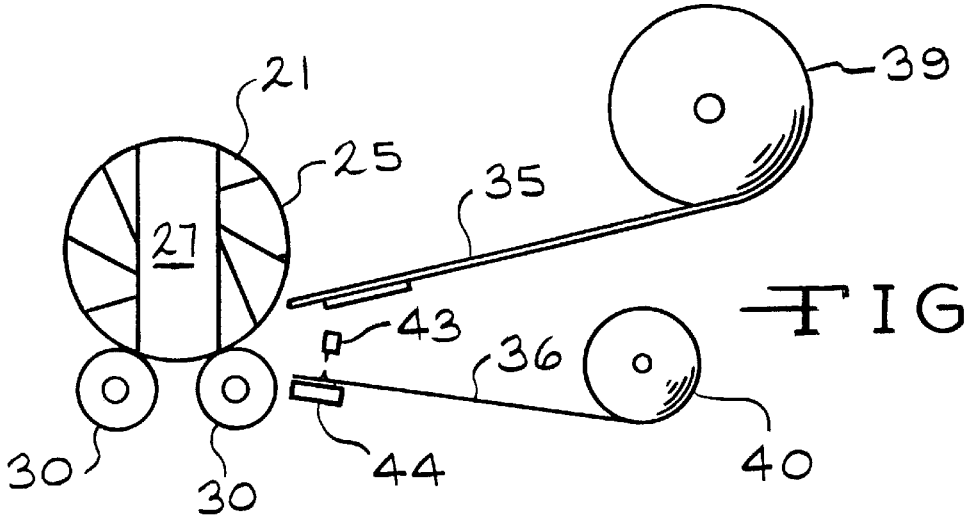
FIG. 11 is a diagrammatic view, showing the second and third layers of material prior to application to the roll being wrapped.
Figure 12:
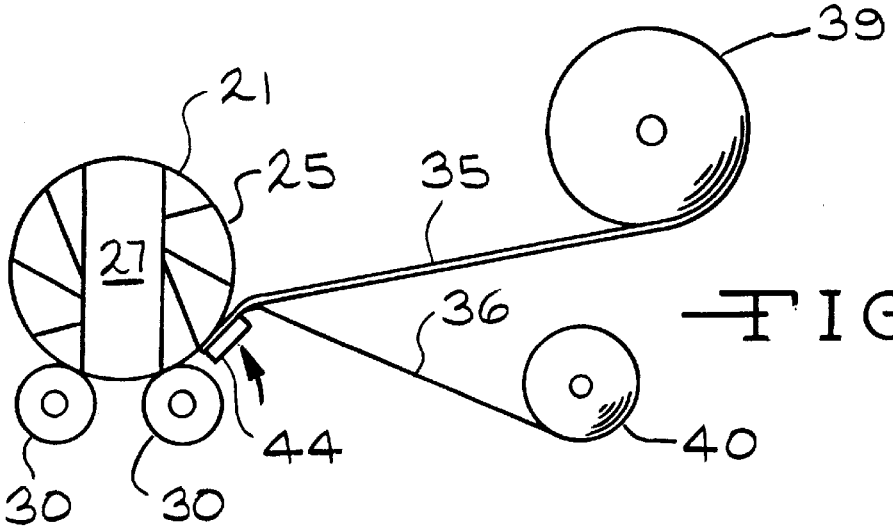
FIG. 12 is a view similar to FIG. 11, showing the second and third layers during their initial application to the roll.
Figure 13:
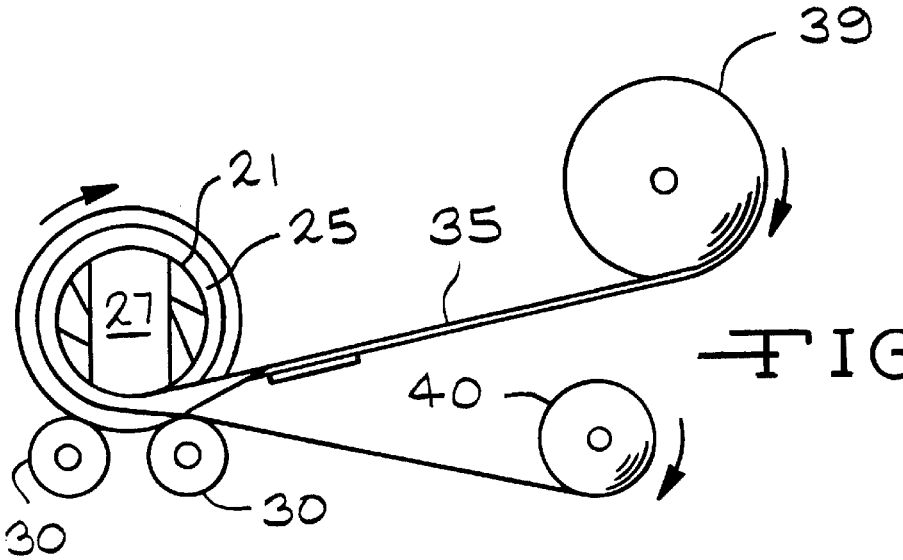
FIG. 13 is a view similar to FIG. 12 showing the second and third layers being radially wrapped on the roll over the first layer.

Referring to FIGS. 11–13, a supply roll 39 dispenses the second layer 35 and a supply roll 40 dispenses the third layer 36. In the present embodiment, the second layer or cushion layer 35 is a plastic foam layer while the third layer 36 is a plastic stretch film such as a polyethylene film having a thickness between 60 gauge and 300 gauge. The third layer 36 can also be formed of other plastic films or layer material.

Referring to FIG. 11, an adhesive dispenser 43 dispenses an adhesive on the end of the third layer 36. In this embodiment, the end of the second layer 35 is interleaved with the third layer 36 and a platen 44 is rotated upwardly against the outer surface 25 to initially adhere or connect the second and third layers 35 and 36 to the outer surface 25. By enclosing the roll 21 in the wrap formed by the first layer 27, possible contamination by the adhesive is eliminated because the adhesive does not contact the roll 21. The cylindrical roll 21 is then rotated, as shown in FIG. 13, and the interleaved second layer 35 and third layer 36 are applied in a radial direction, generally perpendicular to the longitudinal axis 22. As the second layer 35 and third layer 36 are applied over the outer surface 25, it is also in a direction generally perpendicular to the major direction of the first layer 27.

Figure 4:
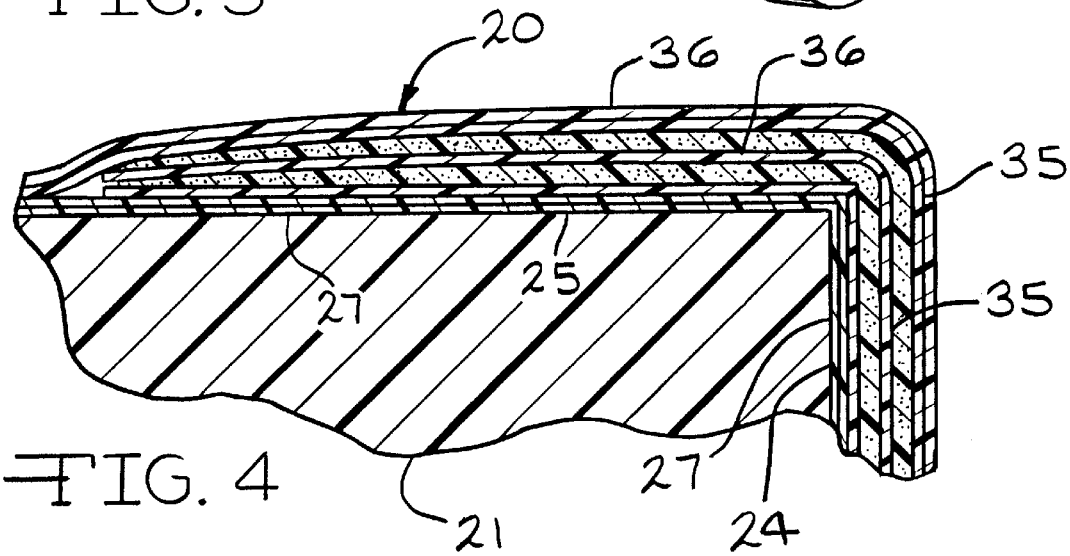
FIG. 4 is a fragmentary enlarged cross-sectional view taken along the line 4—4 of FIG. 3.

In the embodiment shown in FIGS. 3 and 4, a wrap of the third layer 36 forms the outer surface of the package 20. In another embodiment, not shown, the second layer 35 may include a wrap of Kraft paper. The Kraft paper wrap may be used for product identification and is viewable under the outer wrap formed by the third layer 36.

As shown in FIGS. 3 and 4, the second layer 35 and third layer 36 are positioned adjacent the ends 23 and 24 of the roll 21 where they extend downwardly over the ends 23 and 24 to protect the ends 23 and 24 from damage. This type of edge protection is very important when the roll 21 is formed of sensitive or damage prone materials. In the FIGS. 3 and 4 embodiment, the second cushion layer 35 includes separate portions applied on the outer surface 25 adjacent the opposed ends 23 and 24. In this embodiment the second layer 35 does not extend throughout the length of the package 20.

Figure 7:
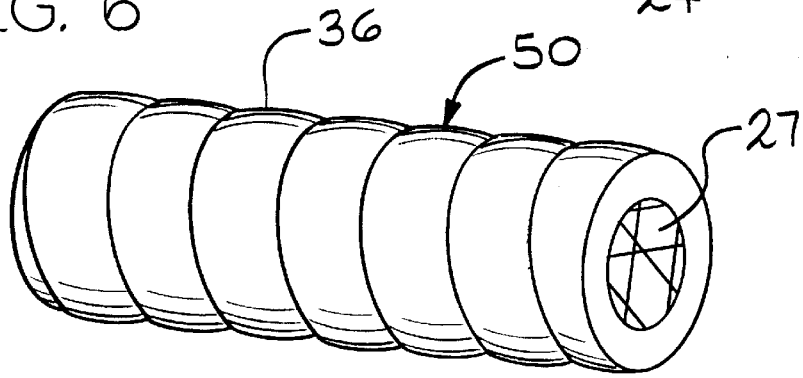
FIG. 7 is a perspective view similar to FIG. 5, showing another embodiment of a package, according to the present invention.

Another embodiment of a package, according to the present invention, is generally indicated in FIG. 7 by the reference number 50. In the package 50, the structure is similar to the structure of the package 20, shown in FIGS. 3 and 4 with the exception that the second cushion layer 35 extends throughout the length of the package 20 covering the entire outer surface 25 of the cylindrical roll 21. In addition, in the package 50, the second cushion layer 35 and third layer 36 are not interleaved, but rather, the layers are successive layers. The second layer 35 is positioned over the first layer 27. Finally the third layer 36 is positioned over the second protective cushion layer 35. The third layer 36 forms the outer wrap of the overall package 50.

Figure 5:
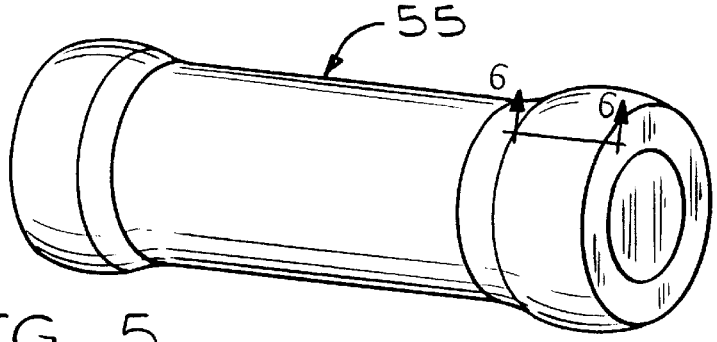
FIG. 5 is a view, similar to FIG. 3, showing another embodiment of a package according to the present invention.
Figure 6:
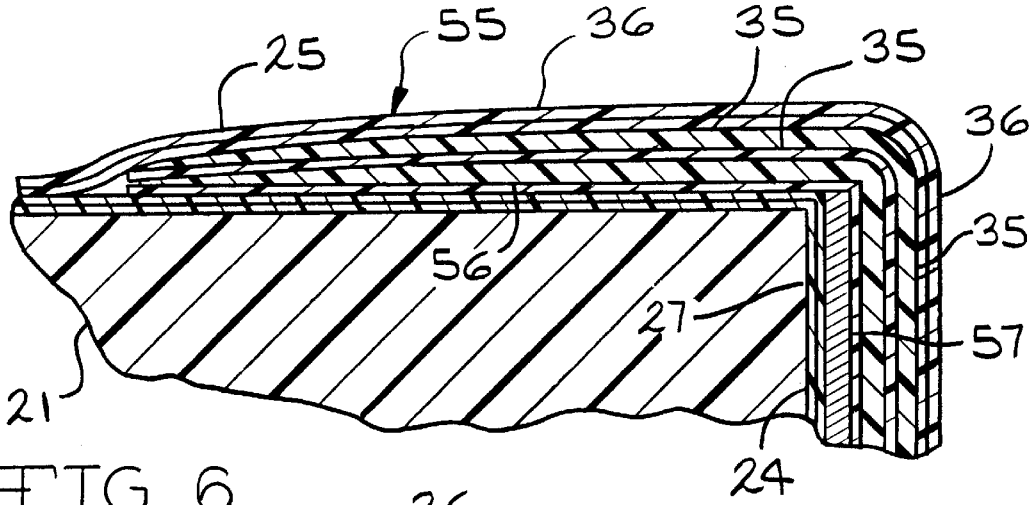
FIG. 6 is an enlarged fragmentary sectional view taken along the line 6—6 of FIG. 5.

A still further embodiment of a package, according to the present invention is generally indicated by the reference number 55 in FIGS. 5 and 6. In this embodiment, the second layer 35 is divided into end portions 56 which are applied adjacent the ends 23 and 24 but do not extend throughout the length of the package 55 across the entire outer surface 25 of the roll 21. In the package 55 a disc, such as a cardboard or corrugated protective disc 57, is applied over the wrap formed by the first layer 27 adjacent the ends 23 and 24. Portions of the protective second layer 35 and the third layer 36 extend around the corners over the periphery of the protective disc 57, as shown in FIG. 6.

Figure 8:
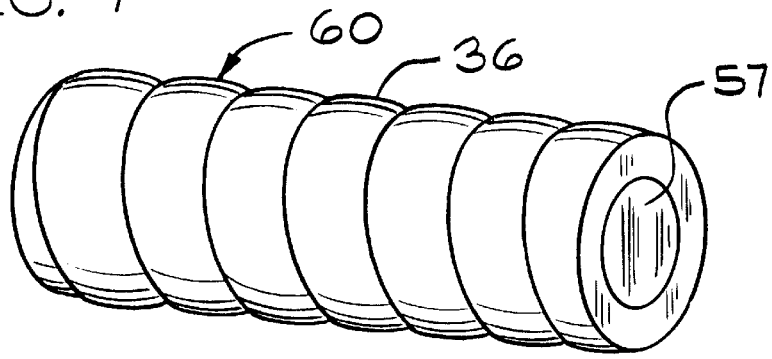
FIG. 8 is a perspective view similar to FIG. 7, showing a still further embodiment of a package, according to the present invention.

A still further embodiment of a package, according to the present invention is generally indicated by the reference number 60 in FIG. 8. The package 60 is similar to the embodiment shown in FIG. 5 and FIG. 6 and includes the protective disc 57. However, in the FIG. 8 embodiment, the second protective layer 35 extends completely over the outer surface 25 of the cylindrical roll 21 with a wrap of the third layer 36 forming the outer surface of the roll package 60.

Figure 14:
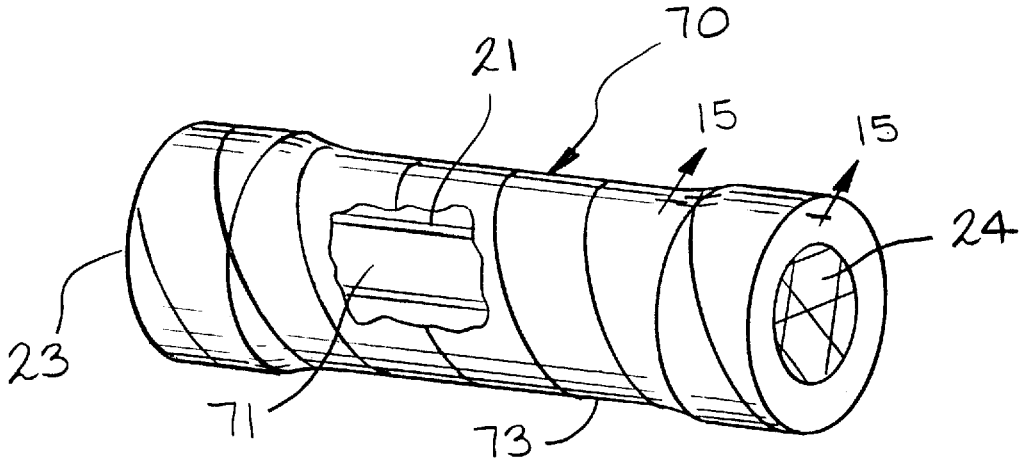
FIG. 14 is another embodiment of a package, according to the present invention.
Figure 15:
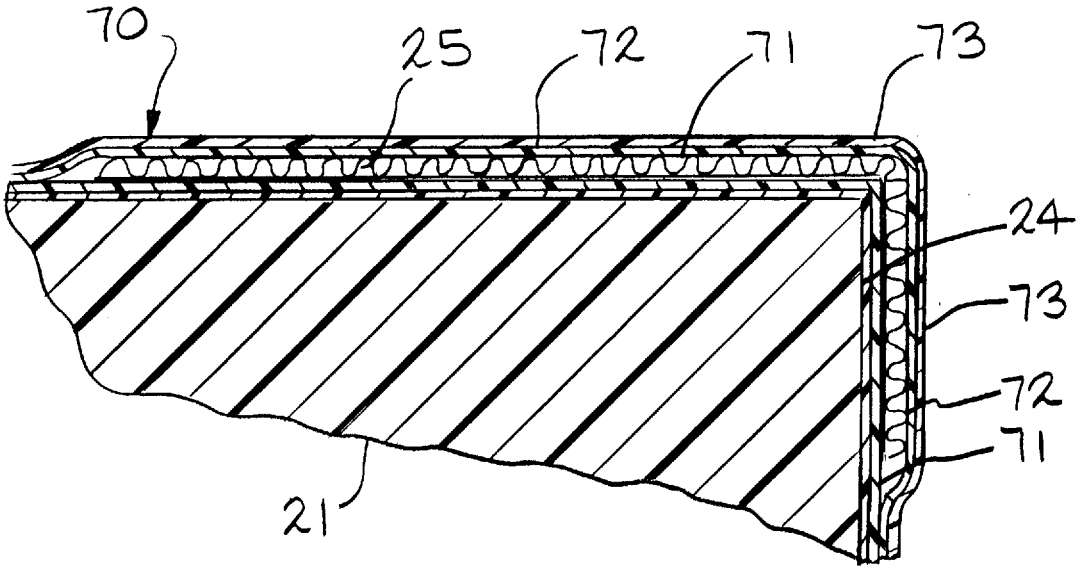
FIG. 15 is a fragmentary sectional view taken along the line 15—15 of FIG. 14.

Referring to FIGS. 14 and 15 another embodiment of a package, according to the present embodiment is indicated by the reference number 70. The package 70 includes an inner or first layer 71 which extends over the surface of the roll 21 in a direction parallel to the longitudinal axis. The first layer 71 is normally a plastic film layer, such as polyethylene film. The package 70 includes a second layer or protective cushion layer 72 which is constructed of a corrugated paper material or a cardboard material. The cushion layer 72 is radially wrapped over the first layer 71. The second cushion layer 72 is applied adjacent the ends of the roll, but not over the entire roll surface. The cushion layer or corrugated layer 72 extends over a portion of the ends 23 and 24 of the roll 21. An outer or third layer 73 is positioned over the second cushion layer 72 and over the entire surface of the roll 21. The third layer is radially wrapped and normally is a plastic film layer. The second layer 72 and third layer 73 extend downwardly or radially inwardly over the ends 23 and 24 to protect the ends 23 and 24 from damage. This type edge or corner protection protects the roll 21. In the FIGS. 14–15 embodiment, the second layer 72 does not extend throughout the length of the roll 20.

Figure 16:
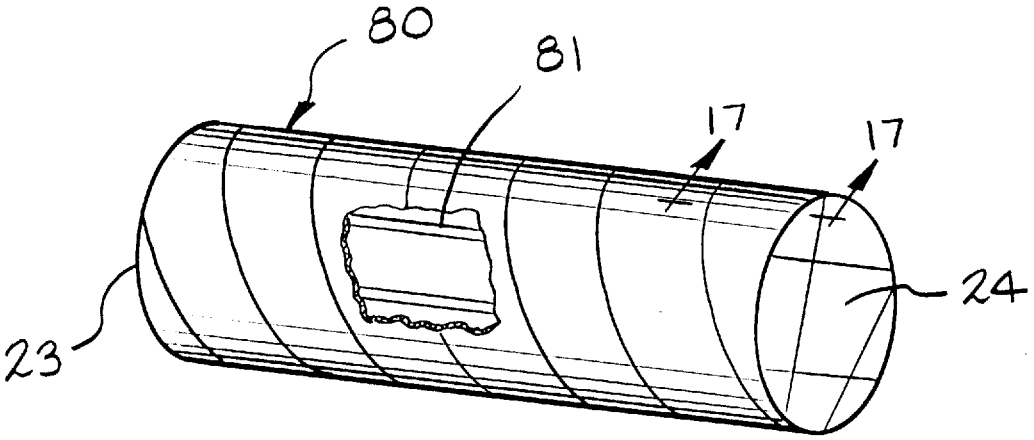
FIG. 16 is a further embodiment of a package according to the present invention.
Figure 17:
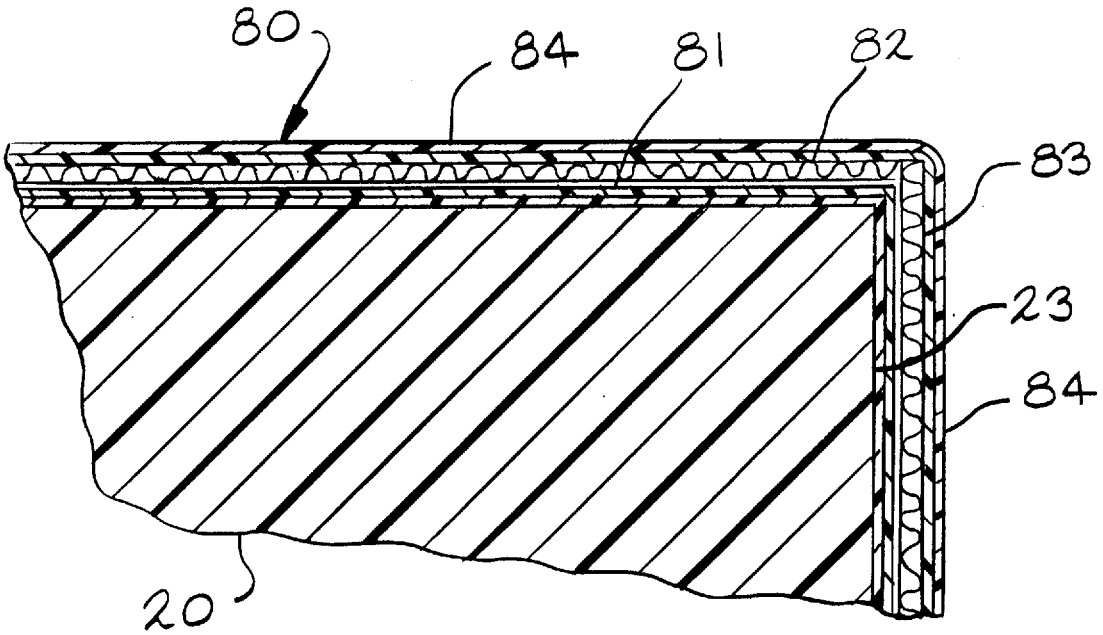
FIG. 17 is a fragmentary sectional view taken along the line 17—17 of FIG. 16.

A further embodiment of a package, according to the present invention, is indicated by the reference number 80 in FIGS. 16 and 17.

The package 80 includes an inner or first layer 81 which extends over the outer surface of the roll 21 in a direction parallel to the longitudinal axis. The first layer 81 is normally a plastic film layer, such as polyethylene film. The package 80 includes a second layer or protective cushion layer 82 which is radially wrapped over the first layer 81 throughout the length of the roll 20. In the present embodiment the second layer 82 is a corrugated material layer or a cardboard material layer.

A corrugated or cardboard disc 83 is positioned over the ends 23 and 24 of the roll 20. A third layer 84 is radially wrapped over the second layer 82 throughout the length of the roll 20. The third layer 84 is preferably a plastic film. The third layer 84 extends over the discs 83 adjacent the ends 23 and 24.

Numerous modifications may be made to the preferred embodiments of the roll package and method of making the roll package described above without departing from the scope of the present invention or from the following claims.

I claim:

1. A package for a roll having a longitudinal axis, a pair of spaced ends and an outer surface extending between the ends and radially spaced from said axis, said package comprising an inner first layer extending over said outer surface of said roll and wrapped on said outer surface in a direction generally parallel to said longitudinal axis, said first layer extending over said spaced ends, a separate second layer positioned over said first layer, said second layer being a cushioned protective layer, said second layer positioned over the outer surface of said first layer adjacent each of said spaced ends in a direction generally perpendicular to said longitudinal axis, and a separate third layer positioned over said second layer in a direction generally perpendicular to said longitudinal axis, said third layer having a portion forming the outermost surface of said package.

2. A package, according to claim 1, wherein said second layer and said third layer are at least partially interleaved.

3. A package, according to claim 1, wherein said second layer and said third layer are successive layers.

4. A package, according to claim 1, wherein said second layer is a foam layer.

5. A package, according to claim 1, wherein said second layer is a bubble pack layer.

6. A package, according to claim 1, wherein said second layer is an extruded plastic material.

7. A package, according to claim 1, wherein said second layer is a corrugated material.

8. A package, according to claim 1, wherein said second layer is a cardboard material.

9. A package, according to claim 1, wherein said first layer is a plastic film.

10. A package, according to claim 1, wherein said third layer is a plastic film.

11. A package, according to claim 1, wherein said second layer includes separate portions applied on said outer surface adjacent said opposed ends, said portions of said second layer extending inwardly over a portion of each of said spaced ends.

12. A package, according to claim 11, wherein said third layer extends throughout the length of said cylindrical body and covers said portions of said second layer.

13. A package, according to claim 1, wherein said second layer extends throughout the length of said cylindrical body.

14. A package, according to claim 1, including a protective end disc positioned on each of said spaced ends.

15. A method of making a package for a roll of material having a longitudinal axis, a pair of spaced ends and an outer surface extending between the ends, said package including first, second and third separate layers, said second layer being a separate protective cushion layer, including the steps of:

axially wrapping said roll with the first layer wherein the first layer is applied on the outer surface in a direction generally parallel to such longitudinal axis; and radially wrapping said roll with the second and third layers wherein said second and third layers are applied on the outer surface in a direction generally perpendicular to such longitudinal axis the third layer positioned over the second layer.

16. A method, according to claim 15, wherein said second and third layers are interleaved as they are applied.

17. A method, according to claim 15, wherein said second and third layers are successively applied.

18. A method, according to claim 15, wherein said second layer is a cushioned protective layer extending throughout the length of said roll.

19. A method, according to claim 15, wherein said second layer is a cushioned protective layer including separate portions applied adjacent said spaced ends of said roll.

20. A package for a roll having a longitudinal axis, a pair of spaced ends and an outer surface extending between the ends and radially spaced from said axis, said package comprising an inner first layer extending over said roll outer surface and wrapped on said outer surface in a direction generally parallel to said longitudinal axis, said first layer extending over said spaced ends, a second layer positioned over said first layer, said second layer positioned over the outer surface of said first layer adjacent each of said spaced ends in a direction generally perpendicular to said longitudinal axis, said second layer being a corrugated material layer, and a third layer positioned on the outer surface of said second layer in a direction generally perpendicular to said longitudinal axis, said third layer having a portion forming the outermost surface of said package.

21. A package for a roll having a longitudinal axis, a pair of spaced ends and an outer surface extending between the ends and radially spaced from said axis, said package comprising an inner first layer extending over said roll outer surface and wrapped on said outer surface in a direction generally parallel to said longitudinal axis, said first layer extending over said spaced ends, a second layer positioned over said first layer, said second layer positioned over the outer surface of said first layer adjacent each of said spaced ends in a direction generally perpendicular to said longitudinal axis, said second layer being a cardboard material layer, and a third layer positioned on the outer surface of said second layer in a direction generally perpendicular to said longitudinal axis, said third layer having a portion forming the outermost surface of said package.

22. A package, according to claim 20, wherein said first layer is a plastic film.

23. A package, according to claim 20, wherein said third layer is a plastic film.

24. A package, according to claim 20, wherein said second layer includes separate portions applied on said outer surface on said first layer adjacent said opposed ends, said portions of said second layer extending inwardly over a portion of each of said spaced ends.

25. A package, according to claim 21, wherein said first layer is a plastic film.

26. A package, according to claim 21, wherein said third layer is a plastic film.

27. A package, according to claim 21, wherein said second layer includes separate portions applied on said outer surface on said first layer adjacent said opposed ends, said portions of said second layer extending inwardly over a portion of each of said spaced ends.

28. A package for a roll having a longitudinal axis, a pair of spaced ends and an outer surface extending between the ends and radially spaced from said axis, said package comprising an inner first layer extending over said roll outer surface and wrapped on said outer surface in a direction generally parallel to said longitudinal axis, said first layer extending over said spaced ends, a second layer positioned over said first layer, said second layer being a cushioned corrugated material protective layer, said second layer positioned over the outer surface of said first layer adjacent each of said spaced ends in a direction generally perpendicular to said longitudinal axis, said second layer including separate portions applied on the outer surface of said first layer adjacent said opposed ends, said portions of said second layer extending inwardly over a portion of each of said spaced ends, and a third layer positioned over the outer surface of said second layer in a direction generally perpendicular to said longitudinal axis, said third layer extending throughout the length of said roll and covering said portions of said second layer, said third layer having a portion forming the outermost surface of said package.

* * * * *